US006128448A

United States Patent [19]

Arcaro et al.

[11] Patent Number: 6,128,448

[45] Date of Patent: Oct. 3, 2000

[54] METHOD AND APPARATUS FOR TONER LEVEL MONITORING AND MOTION SENSING

[75] Inventors: David J. Arcaro; Kenneth A. Lindblom, both of Boise; Wayne E. Foote; Allen L. Frazier, both of Eagle, all of Id.

[73] Assignee: Hewlett-Packard Company, Palo Alto, Calif.

[21] Appl. No.: 09/205,154

[22] Filed: Dec. 3, 1998

[51] Int. Cl.[7] ..... G03G 15/08

[52] U.S. Cl. ..... 399/27; 399/111

[58] Field of Search ..... 399/8, 27, 24, 399/25, 26, 61, 111, 116, 119, 258, 262; 347/86; 222/DIG. 1; 235/461, 449; 414/411; 73/862.328, 862.329

[56] References Cited

U.S. PATENT DOCUMENTS

| | | | |
|---|---|---|---|
| 4,771,313 | 9/1988 | Kuroda et al. | 399/25 |
| 4,989,754 | 2/1991 | Grasso et al. | 222/39 |
| 5,049,898 | 9/1991 | Arthur et al. | 346/1.1 |
| 5,365,312 | 11/1994 | Hillmann et al. | 355/206 |
| 5,420,676 | 5/1995 | Arcaro | 355/271 |
| 5,634,169 | 5/1997 | Barry et al. | 399/27 X |
| 5,708,912 | 1/1998 | Lee | 399/24 |
| 5,923,917 | 7/1999 | Sakurai et al. | 399/27 |
| 5,930,553 | 7/1999 | Hirst et al. | 399/24 X |

FOREIGN PATENT DOCUMENTS

| | | | |
|---|---|---|---|
| 0832749A2 | 4/1997 | European Pat. Off. | B41J 2/175 |
| 0873873A2 | 12/1997 | European Pat. Off. | B41J 2/175 |
| WO98/52762 | 4/1998 | WIPO | B41J 2/01 |

OTHER PUBLICATIONS

UK Search Report.

*Primary Examiner*—Arthur T. Grimley
*Assistant Examiner*—Hoan Tran

[57] ABSTRACT

In a device including a replaceable cartridge containing a consumable material, the cartridge having at least one moving part, a system for estimating the use of consumable material from the cartridge is disclosed. The system includes an information storage medium secured to the moving part of the cartridge. A read-write head is mounted in the device in proximity with the information storage medium, and is adapted and constructed to write information on and read information from the information storage medium. The storage medium can be provided as a magnetic storage medium, which may be configured as an annular disc. The moving part can be provided as a generally cylindrical roller assembly including a drive gear. The drive gear can include an end surface to which the storage medium may be secured. The device itself can be any suitable printing device, such as a laser printer. The cartridge may be provided as a toner cartridge, in which instance the consumable material would be toner. In an embodiment, the storage medium may be secured to an Organic Photo Conductor ("OPC") roller. A method for estimating the use of consumable material from the cartridge is also disclosed, in which the read/write head is actuated to write cartridge use information on and read cartridge use information from the information storage medium in response to operation of the device.

20 Claims, 1 Drawing Sheet

METHOD AND APPARATUS FOR TONER LEVEL MONITORING AND MOTION SENSING

CROSS-REFERENCE TO RELATED APPLICATIONS

NONE

TECHNICAL FIELD

This invention relates to the field of monitoring usage of consumable materials contained in replaceable cartridges associated with printing devices. More specifically, this invention relates to monitoring usage of toner contained in toner cartridges for laser printers.

BACKGROUND OF THE INVENTION

The desirability of monitoring the use and remaining quantities of consumable printing materials in electrophotographic printing devices has been recognized almost since the inception of the technology itself. As such devices came into use in virtually every place of business in one form or another, the need for a practical and reliable way to sense, for example, toner level in a laser printer or copier, became increasingly apparent. To this end, various systems and methods have been proposed for directly or indirectly sensing the level of consumable flowable materials in printing devices.

One such system is described in U.S. Pat. No. 4,989,754 to Grasso et al., which is directed to a toner cartridge having a low toner sensing mechanism. The mechanism includes a rotatable arm assembly internal to the cartridge, upon which is mounted a magnet. A reed switch is located outside the cartridge. Leads attached to the reed switch are designed to close a circuit when the magnet, due to insufficient levels of toner inside the cartridge, comes into proximity with the switch. Closure of the circuit produces warning indications to the operator of the printer.

Another device is set forth in U.S. Pat. No. 5,049,989 to Arthur et al. This patent describes an ink jet printhead including a carriage having a housing upon which a memory element is mounted. The memory element may be a strip of magnetic media, a semiconductor memory, or an optical medium. A read/write head is mounted in proximity with the path of travel of the printhead, and reads and/or updates information on the memory element each time the printhead passes its location.

U.S. Pat. No. 5,634,169 to Barry et al. discusses a cartridge for a printing device in which a multiple function encoder wheel is used to generate characteristic information about the cartridge. The wheel employs a paddle traveling through the toner material, and acts in conjunction with a coded wheel reader to indicate a component of resistance, thus giving an indication of the amount of toner remaining in the cartridge.

Yet another system is disclosed in U.S. Pat. No. 5,708,912 to Lee, in which a non-volatile memory is used to store data values representing various characteristics of a printing device. The system employs a piezoelectric toner sensor mounted within the cartridge.

It can be seen from these exemplary patents that the problem of directly sensing print media levels, particularly levels of materials such as toner and ink, has been the subject of a great deal of inventive effort. Unfortunately, despite these efforts, several problems remain. For example, mechanical sensors using magnets, piezo elements, and the like are relatively expensive and often unreliable. Furthermore, they frequently extend through the wall of the toner reservoir, increasing the difficulty of manufacturing the cartridge and introducing the possibility of leaks. Methods such as encoder wheels and embedded nonvolatile memory chips avoid such problems by approximating the amount of toner used through tracking print quantities. However, these systems usually require complicated and expensive multi-lead interconnects, which are frequently more expensive than the memory chips themselves.

Even the relatively simple solution proposed in the patent to Arthur et al. has its drawbacks. The system necessitates movement of the printing head past the read/write head in order to function. Thus, the print head is required to execute otherwise unnecessary movement in order to register information on ink levels and other system parameters.

It is apparent from the foregoing that the need exists for a cartridge assembly having a consumable material level monitoring system that will minimize the complexity and expense involved in manufacturing the cartridge while providing a reliable source of system status information.

SUMMARY OF THE INVENTION

In order to accomplish the present invention, there is provided, in a device including a replaceable cartridge containing a consumable material, the cartridge having at least one moving part, a system for estimating the use of consumable material from the cartridge. The system includes an information storage medium secured to the moving part of the cartridge. A read-write head is mounted in the device in proximity with the information storage medium, and is adapted and constructed to write information on and read information from the information storage medium.

The storage medium can be provided as a magnetic storage medium, which may be configured as an annular disc.

The moving part can be provided as a generally cylindrical roller assembly including a drive gear. The drive gear can include an end surface to which the storage medium may be secured.

The device itself can be any suitable printing device, such as a laser printer. The cartridge may be provided as a toner cartridge, in which instance the consumable material would be toner. In an embodiment, the storage medium may be secured to an Organic Photo Conductor ("OPC") roller. A felt wiper can be interposed between the storage medium and the read/write head.

The system can further include an actuation mechanism for actuating the read/write head in response to operation of the moving part.

Also disclosed, in a device including a replaceable cartridge containing a consumable material, the cartridge having at least one moving part, is a method for estimating the use of consumable material from the cartridge. In a first step, the method involves securing an information storage medium to the moving part of the cartridge. Next, a read-write head is mounted in the device in proximity with the information storage medium. The read/write head is then actuated to write cartridge use information on and read cartridge use information from the information storage medium in response to operation of the device. The step of securing an information storage medium to the moving part can include securing an information storage medium to an end surface of a generally cylindrical roller assembly.

BRIEF DESCRIPTION OF THE DRAWINGS

A better understanding of the invention may be had from the consideration of the following detailed description taken in conjunction with the accompanying drawings, in which.

DETAILED DESCRIPTION OF THE PREFERRED EMBODIMENTS

Figure 1:
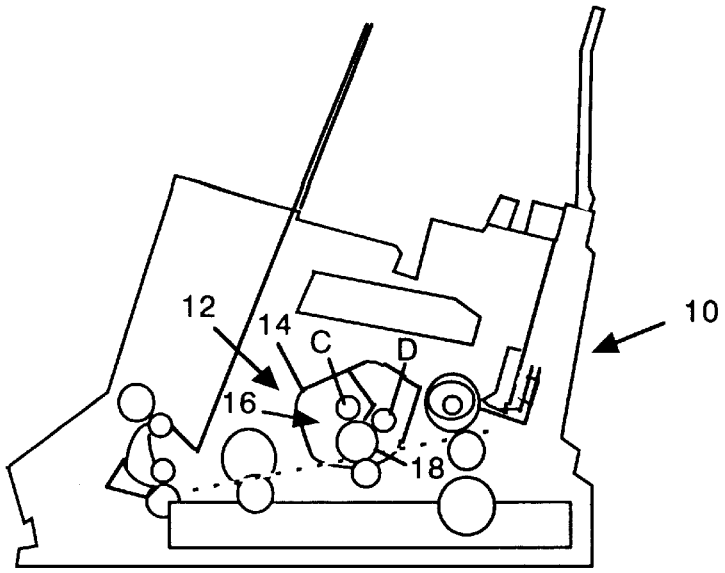
FIG. 1 is a schematic view of a printing device embodying the principles of the present invention.

The present invention is not limited to a specific embodiment illustrated herein. FIG. 1 illustrates a printer 10 including a cartridge 12 containing consumable printing material. For illustrative purposes, the printer 10 will be described as a laser printer and the cartridge 12 as a toner cartridge, although it is to be understood that the present invention may find utility with any number of suitable printing devices, e.g., copiers, fax machines, and the like. Similarly, the cartridge 12 could contain any flowable consumable printing material.

The cartridge 12 includes a housing 14 in which a plurality of roller assemblies 16 are mounted for relative movement. The roller assemblies 16 include a charger roller assembly C, a developer roller assembly D, and an organic photoconductor (OPC) roller 18, the function of which is known per se and described in U.S. Pat. No. 5,522,797 to Arcaro, the specification of which is incorporated by reference herein.

Figure 2:
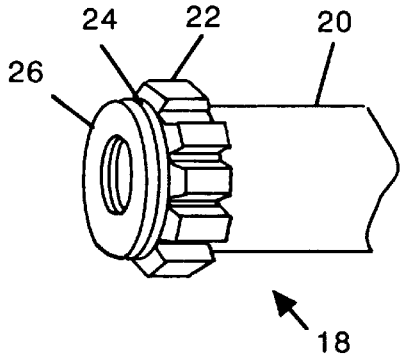
FIG. 2 is a perspective view of a roller.
Figure 3:
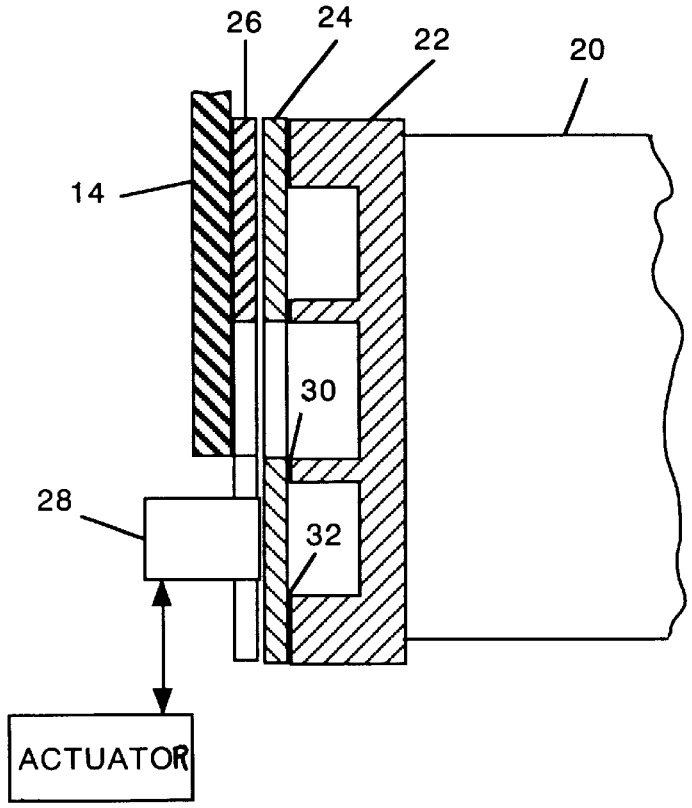
FIG. 3 is a sectional view of a roller and read/write head.

As can be seen in FIGS. 2 and 3, the OPC roller assembly 18 includes an OPC drum 20 to which is attached a molded drive gear 22. An information storage medium 24 is secured to the gear 22. The storage medium 24 can be provided as a magnetic storage medium, functionally identical to that which may be found in a conventional one-sided floppy disk drive. The medium can be bulk prepared (formatted and data written), and then secured to the gear 22 by any suitable means, such as ultrasonic welding or adhesive. A felt wiper 26 is provided to maintain a clean outer surface on the magnetic medium 24, again in a way similar to that employed in floppy disk drives. A read/write head 28 is mounted on the printer 10 in proximity with the cartridge 12. The read/write head 28 may be provided as a standard one-position read/write head identical to those used in floppy disk drives, and is located in a position in which it can write information on and read information from the information storage medium 24 as the OPC roller assembly 18 turns during operation of the printer 10. Permanently mounting the read/write head 28 to the printer eliminates the need for electrical interconnects to the cartridge 12. Elimination of the interconnects serves to reduce the overall cost and complexity of the system.

As can be seen in FIG. 3, the medium 24 is supported only at its inside and outside edges 30, 32 to permit optimally reliable location of the storage medium 24 with respect to the read/write head 28. The medium 24 is fabricated from relatively flexible material, and is thus permitted a degree of flexure between edges 30 and 32 during operation. The felt wiper 26 is secured to an inside surface of the cartridge housing 14 in such a way as to be in contact with, but not secured to, the medium 24. Consequently, the felt wiper 26 remains stationary during rotation of the roller 18.

In operation, as the device 10 is actuated, the OPC roller assembly 18 rotates, thus causing the storage medium 24 to move past the read/write head 28. The read/write head 28 may then be used to write information onto, or read information from, the storage medium 24. Such information may include, for example, a count of printed dots performed with the particular cartridge, which has been found to correlate fairly accurately with toner usage. Other information, such as page count, etc., may also be written and stored. Information written onto the storage medium remains with the cartridge itself, enabling cartridges to be "swapped" from device to device without the loss of information.

The present invention permits "on-board" non-volatile data storage at relatively low cost, since the only components added to the replaceable cartridge are the storage medium and, optionally, a cleaning device such as the felt wiper. The data capacity of the storage medium as illustrated is potentially several orders of magnitude greater than that of known systems. This increased memory capacity permits added functionality to the toner cartridge, such as compatibility or brand recognition, encrypted proprietary features, firmware upgrades for the printer itself, and tracking of printer usage via returned cartridges. Further, the storage medium and read/write head can be used as a high-resolution encoder for the OPC roller. Thus, with no additional cost, the disclosed system would enable desirable functions such as active banding correction while eliminating the cost and complexity of known encoders.

Although the preferred embodiment of the present invention has been illustrated, and that form described, it is readily apparent to those skilled in the art that various modifications may be made therein without departing from the spirit of the invention, or form the scope of the appended claims.

What is claimed is:

1. In a device including a replaceable cartridge containing a consumable material, the cartridge having at least one moving part, a system for estimating the use of consumable material from the cartridge, the system comprising the following:

an information storage medium secured to the moving part of the cartridge, the information storage medium being adapted and constructed to provide information to, and accept information from, a read-write head; and a read-write head, mounted in the device in proximity with the information storage medium, adapted and constructed to write information on and read information from the information storage medium.

2. A system in accordance with claim 1, wherein the storage medium comprises a magnetic storage medium.

3. A system in accordance with claim 2, wherein the magnetic storage medium comprises an annular disc.

4. A system in accordance with claim 1, wherein the moving part comprises a generally cylindrical roller assembly including a drive gear.

5. A system in accordance with claim 4, wherein the drive gear of the generally cylindrical roller assembly comprises an end surface, and the storage medium is secured to the end surface of the drive gear.

6. A system in accordance with claim 5, wherein the device comprises a laser printer.

7. A system in accordance with claim 6, wherein the cartridge comprises a toner cartridge and the consumable material comprises toner.

8. A system in accordance with claim 7, wherein the roller assembly comprises an OPC roller.

9. A system in accordance with claim 6, further comprising a felt wiper interposed between the storage medium and the read/write head.

10. A system in accordance with claim 1, further comprising an actuation means for actuating the read/write head in response to movement of the moving part.

11. In a replaceable toner cartridge for a laser printing device, the toner cartridge having at least one moving part that moves with respect to the rest of the cartridge during operation of the cartridge, a system for estimating the use of toner from the cartridge, the system comprising the following:

an information storage medium secured to the moving part of the cartridge, the information storage medium being adapted and constructed to provide information to, and accept information from, a read-write head; and a read-write head, mounted in the laser printing device in proximity with the information storage medium, adapted and constructed to write information on and read information from the information storage medium.

12. A system in accordance with claim 11, wherein the moving part comprises a generally cylindrical roller assembly including a drive gear.

13. A system in accordance with claim 12, wherein the drive gear of the generally cylindrical roller assembly comprises an end surface, and the storage medium is secured to the end surface of the drive gear.

14. A system in accordance with claim 13, wherein the roller comprises an OPC roller.

15. A system in accordance with claim 14, further comprising a felt wiper interposed between the storage medium and the read/write head.

16. A system in accordance with claim 11, wherein the storage medium comprises a magnetic storage medium.

17. A system in accordance with claim 16, wherein the magnetic storage medium comprises an annular disc.

18. A system in accordance with claim 11, further comprising an actuation means for actuating the read/write head in response to movement of the moving part.

19. In a device including a replaceable cartridge containing a consumable material, the cartridge having at least one moving part, a method for estimating the use of consumable material from the cartridge, the method comprising the following steps:

securing an information storage medium to the moving part of the cartridge, the information storage medium being adapted and constructed to provide information to, and accept information from, a read-write head;

mounting a read-write head in the device in proximity with the information storage medium; and actuating the read/write head to write cartridge operation information on and read cartridge operation information from the information storage medium in response to operation of the device.

20. A method in accordance with claim 19, wherein the moving part of the cartridge comprises an OPC roller, and the step of actuating the read/write head comprises actuating the read/write head to transmit information containing encoding data for the OPC roller.

* * * * *